United States Patent [19]

Stahlecker et al.

[11] Patent Number: 5,012,557

[45] Date of Patent: May 7, 1991

[54] DRAFTING UNIT WITH DETACHABLY MOUNTED SUPPORT COMPONENTS FOR BOTTOM ROLLERS

[76] Inventors: Fritz Stahlecker, Josef-Neidhart-Strasse 18, 7347 Bad Uberkingen; Hans Stahlecker, Haldenstrasse 20, 7334 Sussen, both of Fed. Rep. of Germany

[21] Appl. No.: 473,160

[22] Filed: Jan. 31, 1990

[30] Foreign Application Priority Data

Feb. 14, 1989 [DE] Fed. Rep. of Germany ..... 3904348

[51] Int. Cl.[5] ..... D01H 5/74

[52] U.S. Cl. ..... 19/258; 19/236; 19/271; 19/293

[58] Field of Search ..... 19/236, 258, 266, 271, 19/294, 295, 237, 242, 293

[56] References Cited

U.S. PATENT DOCUMENTS

| | | | |
|---|---|---|---|
| 765,717 | 7/1904 | Shaw | 19/293 |
| 1,182,165 | 5/1916 | Goldsmith, Jr. | 19/295 |
| 1,783,301 | 12/1930 | Morton | 19/293 |
| 1,912,946 | 6/1933 | Litty | 19/293 |
| 1,933,222 | 10/1933 | Rooney | 19/294 |
| 2,329,655 | 9/1943 | Shaw | 19/294 |
| 2,387,091 | 10/1945 | Rooney | 19/293 |
| 2,716,779 | 9/1955 | Reynolds | 19/295 |
| 2,965,934 | 12/1960 | Swanson | 19/266 |
| 3,216,065 | 11/1965 | Grieb | 19/266 |
| 3,303,534 | 2/1967 | Andreani | 19/266 |
| 3,401,430 | 9/1968 | Whitehurst | 19/294 |
| 4,484,376 | 11/1984 | Glock et al. | 19/236 |
| 4,768,262 | 9/1988 | Gunter | 19/258 |

FOREIGN PATENT DOCUMENTS

| | | | |
|---|---|---|---|
| 3517614 | 10/1985 | Fed. Rep. of Germany | 19/236 |
| 62-69832 | 3/1987 | Japan . | |
| 2162029 | 7/1987 | Japan | 19/293 |

*Primary Examiner*—Werner H. Schroeder
*Assistant Examiner*—Michael A. Neas
*Attorney, Agent, or Firm*—Evenson, Wands, Edwards, Lenahan & McKeown

[57] ABSTRACT

A drafting unit for a spinning machine has several stub shaft supported bottom rollers which are each assigned to a spinning point and which are in driving connection with drive shafts extending through in longitudinal direction of the machine. To facilitate servicing operations, the bottom rollers are held by means of support components which are detachably mounted at a machine frame which accommodates the drive shafts.

16 Claims, 2 Drawing Sheets

DRAFTING UNIT WITH DETACHABLY MOUNTED SUPPORT COMPONENTS FOR BOTTOM ROLLERS

BACKGROUND AND SUMMARY OF THE INVENTION

The invention relates to a drafting unit for a spinning machine having several over-mounted bottom rollers which are each assigned to a spinning point and which are in driving connection with drive shafts extending through in the longitudinal direction of the machine.

In a known construction of the initially mentioned type (JP-A 62-69832), a common housing is provided for two adjacent drafting units respectively which encloses the driving connection of all bottom rollers of these two drafting units. The drive shafts are disposed in this housing. The bottom rollers each have bearing housings by means of which they are detachably arranged in the common housing. Although, in the case of this construction, the bottom rollers can be demounted relatively easily together with their bearings, a servicing of the other elements is connected with considerable mounting expenditures, in which case it is also necessary to stop the whole spinning machine during servicing work at one spinning point.

An object of the invention is to develop drafting unit of the initially mentioned type such that servicing operations are easier to carry out.

This object is achieved in that the bottom rollers are held by components which are detachably mounted at a machine frame which accommodates the drive shafts.

As a result of this development, it is possible to demount and remount one or several bottom rollers of a spinning point with the pertaining structural elements without interfering with the operation of the adjacent drafting units.

In a further development of preferred embodiments the invention, it is provided that the bottom rollers are each, fastened to a component by means of their own holding device. In this case, it is expedient for the bottom rollers to each be disposed on shafts and to be connected with the pertaining drive shaft by way of a toothed-wheel drive containing a shiftable coupling. In particular, if the coupling and a pertaining toothed wheel are arranged coaxially with respect to the bottom roller and are therefore also held by the holding device of the respective bottom roller, when a bottom roller is demounted, the coupling is at the same time also demounted together with it, so that it can then be examined.

In a further development of preferred embodiments of the invention, it is provided that the bottom rollers of one spinning point are held at one support respectively which extends transversely with respect to the longitudinal direction of the machine and which is mounted at the machine frame. As a result, by means of simple mounting work, such as soldering or remounting of the support, it may be achieved that all bottom rollers of a drafting unit are removed or remounted simultaneously. In a further development of this embodiment, it is provided that the supports accommodating the bottom rollers of two adjacent spinning points are constructed as a frame by means of struts extending in longitudinal direction of the machine. As a result, the bottom rollers of two adjacent spinning points are combined to a structural unit which can be mounted or demounted as such. In a particularly expedient development, it is provided in this case that one of the struts is constructed as a supporting rod on which a carrying and loading arm is pivotably disposed. This carrying and loading arm accommodates the top rollers of the two adjacent drafting units so that, as a result, these two adjacent drafting units can be mounted and demounted as a complete structural unit, only the drive shafts remaining at the machine. The demounting or the mounting is not hindered by the drive shafts remaining in the machine frame so that this work can take place without stopping the spinning machine. At least it is ensured that the machine can continue to run also after the demounting of the adjacent drafting units constructed as a subassembly. The reason is that the bearing of the drive shafts is not affected.

Other objects, advantages and novel features of the present invention will become apparent from the following detailed description of the invention when considered in conjunction with the accompanying drawings.

DETAILED DESCRIPTION OF THE DRAWINGS

Figure 1:
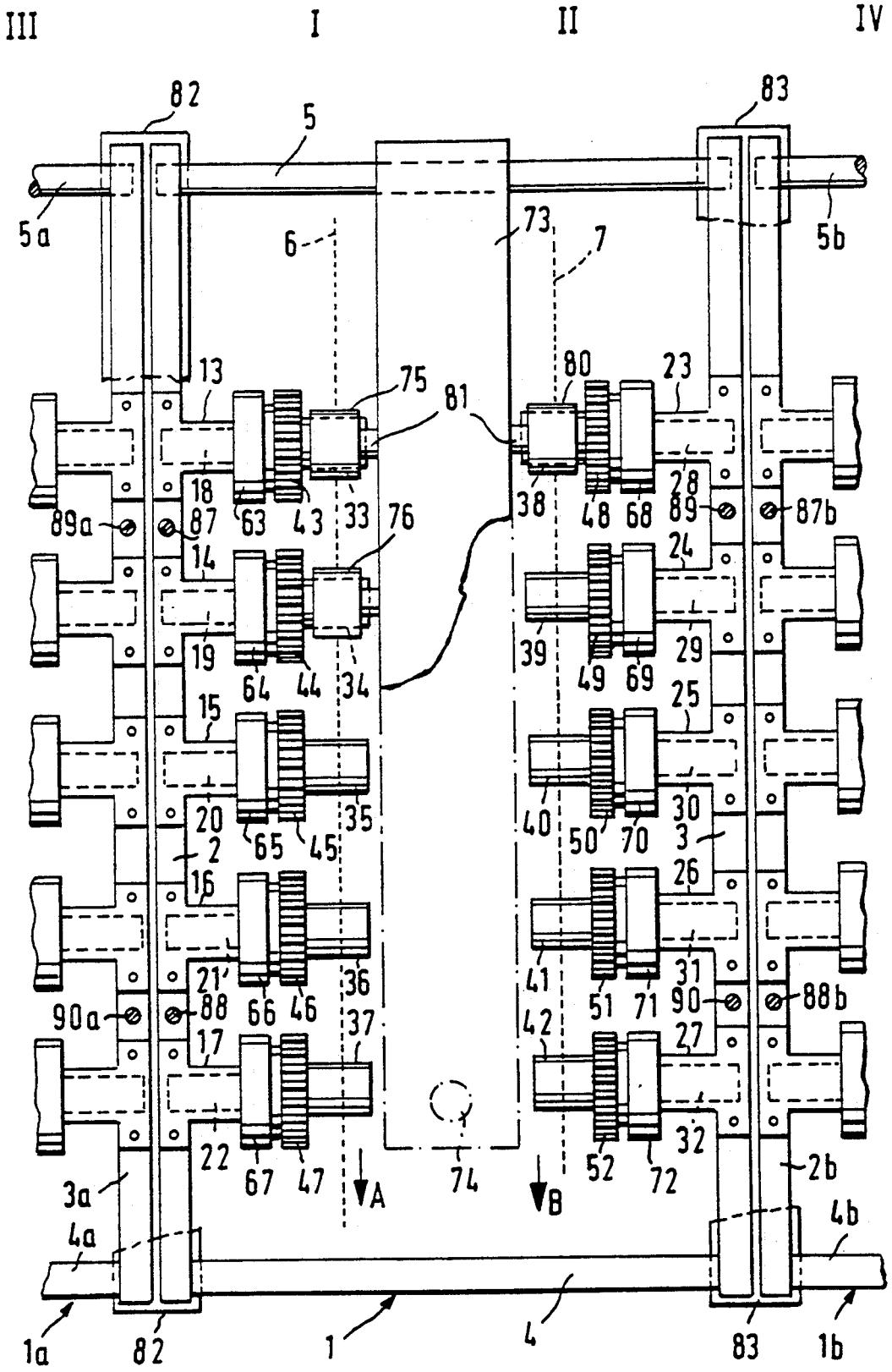
FIG. 1 is a top schematic view of two adjacent drafting units of a spinning machine constructed according to a preferred embodiment of the invention and FIG. 2 is a partial section lateral view of the drafting units according to FIG. 1.

FIG. 1 is a top view of two drafting units I, II which are part of two adjacent spinning points or units of a spinning machine. This spinning machine has a plurality of spinning points which are arranged next to one another in the longitudinal direction of the machine and of which in FIG. 1 the respective adjacent drafting units III, IV also are partially shown. The drafting units I, II form so-called spinning lines 6, 7 which extend transversely with respect to the longitudinal direction of the machine and along which a sliver is transported in the direction of the arrows (A) and (B) which is drawn to the desired yarn size. The two slivers may each be processed to form a yarn in its own spinning unit. However, embodiments are also contemplated wherein, after providing the two slivers of adjacent drafting units I, II with a twist in twisting elements which are not shown, they are guided together to form a double yarn and then wound as a double yarn onto a common spool package.

The drafting units I, II each have five bottom rollers 33, 34, 35, 36, 37 and 38, 39, 40, 41, 42, which are arranged behind one another in the direction of the spinning lines 6, 7 and are driven with increasing speed. Respective top rollers 75, 76, 77, 78, 79 are assigned to these bottom rollers 33 to 42. For reasons of representation, only the top roller 80 of the pair of feed rollers of drafting unit II is shown in FIG. 1.

Figure 2:
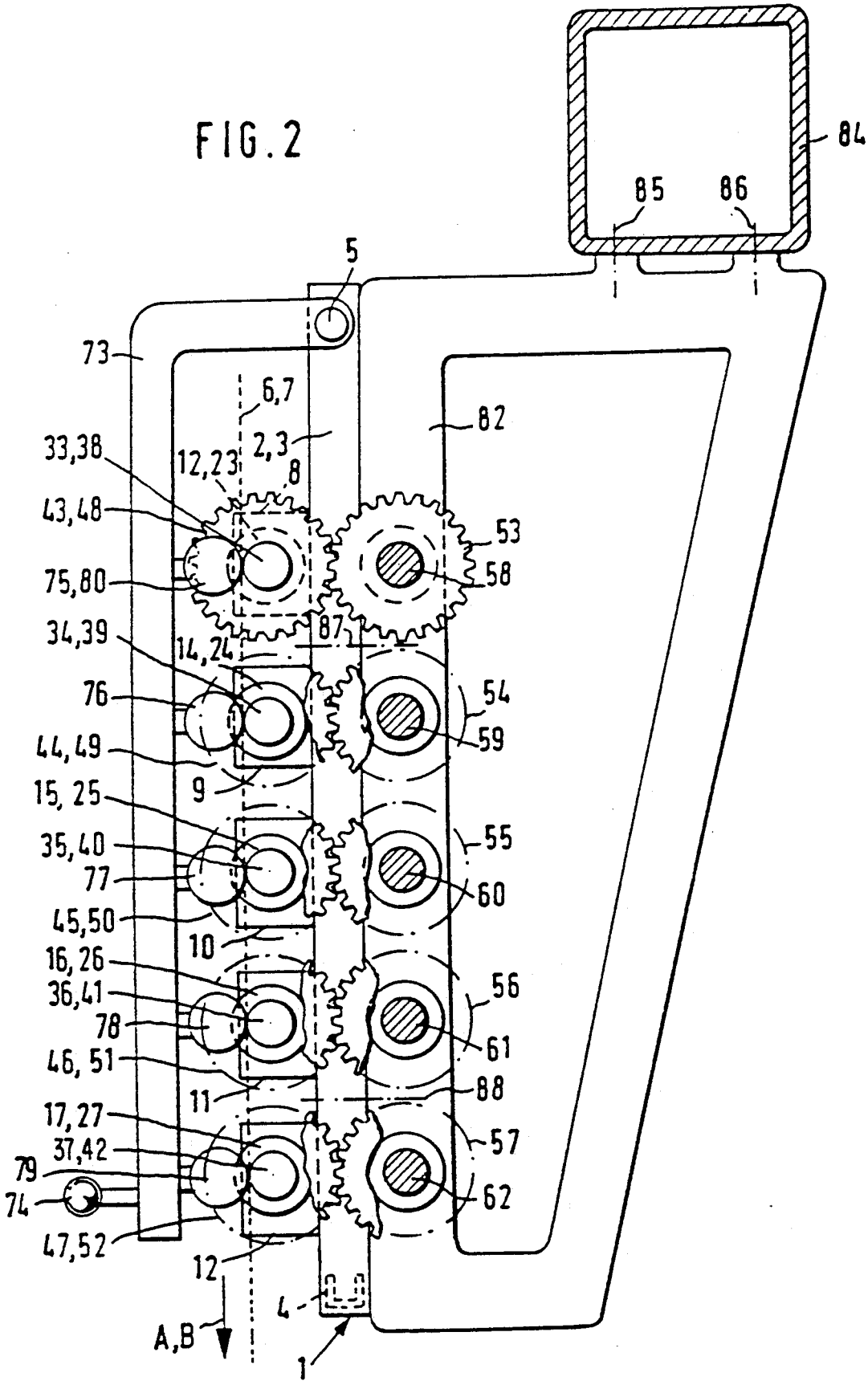

The top rollers 75 to 80 are constructed as rollers which loosely rotate along. The bottom rollers 33 to 42 are equipped with drives. As shown in FIG. 2, drive shafts 58, 59, 60, 61, 62 extending through in the longitudinal direction of the machine are assigned to these bottom rollers 33 to 42, these drive shafts 58, 59, 60, 61, 62 each being equipped with a toothed wheel 53, 54, 55, 56, 57. These toothed wheels 53 to 57 mesh with toothed wheels 43, 44, 45, 46, 47 of drafting unit I and 48, 49, 50, 51, 52 of drafting unit II. The toothed wheels 43 to 47 and 48 to 52 are disposed on shafts 18, 19, 20, 21, 22 of drafting unit I and shafts 28, 29, 30, 31, 32 of drafting unit II respectively, which also receive the bottom rollers 33 to 37 and 38 to 42. A shiftable coupling 63, 64, 65, 66, 67 is in each case assigned to the bottom rollers 33 to 37 which establishes and releases a driving connection between the bottom rollers 33 to 37 and the toothed wheels 43 to 47. In a corresponding manner, shiftable couplings 68, 69, 70, 71, 72 are assigned to the bottom rollers 38 to 42. The bottom rollers 33 to 37 and 38 to 42 can therefore, in each case, be separated from the continuing drive shafts 58 to 62 by the opening of the couplings 63 to 67 and 68 to 72. The shafts 18 to 22 and 28 to 32 are, in each case, clamped into holding devices 13, 14, 15, 16, 17 and 23, 24, 25, 26, 27.

These holding devices 13 to 17 and 23 to 27 have carriage-type projections 8, 9, 10, 11, 12 (FIG. 2) by means of which they are fastened on supports 2, 3 extending transversely with respect to the longitudinal direction of the machine. These supports 2, 3, in turn are fastened by means of screws 87, 88 and 89, 90 to frame-type supporting elements 82, 83 which also extend transversely with respect to the longitudinal direction of the machine. The drive shafts 58 to 62 are disposed in these frame-type supporting elements 82, 83.

The frame-type supporting elements 82, 83 are fastened from below by means of screws 85, 86 to a supporting profile 84 extending through in the longitudinal direction of the machine. In order to explain that the respective connecting drafting units III and IV consist of the same elements which are each arranged mirror-invertedly with respect to the elements of drafting units I and II which are themselves arranged mirror-invertedly with respect to one another, these, to the extent that they are visible, were provided with the same reference numbers which were supplemented by the letter (a) for drafting unit III and by the letter (b) for drafting unit IV.

The supports 2, 3 of drafting units I, II are combined to a frame 1 by means of two cross-struts 4, 5 which are each arranged in their end area. Strut 5 is constructed as a supporting rod on which a carrying and loading support 73 is pivotably arranged which carries the top rollers 75 to 80, the respectively opposite top rollers 75, 80 being combined to a so-called pressure roller twin which has a common shaft 81. The corresponding situation applies to the other top rollers. The carrying and loading arm 73, which is equipped with a handle 74, in a known manner, contains loading elements by means of which the contact pressure force of the top rollers 75 to 80 can be adjusted.

The drafting units I, II form a structural unit which can be mounted and demounted as such, in which case only the screws 87 to 90 must be unscrewed or applied. The drive shafts 58 to 62 remain in the machine frame so that they do not impair the operation of the adjacent drafting units III, IV. It is therefore possible, if required, to completely mount and demount adjacent drafting units I, II in a simple manner. If, however, damage occurs at only one of the bottom rollers 33 to 42 or one of the couplings 63 to 72 and corresponding servicing operations become necessary, it is possible to demount the corresponding subassembly by demounting the corresponding holding device 13 to 17 or 23 to 27.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A drafting unit for a spinning machine comprising:
a plurality of bottom rollers supported on one end portion of bottom roller shafts, said bottom rollers being in driving connection with respective drive shafts extending through in a longitudinal direction of the machine,
and bottom roller shaft support components bearingly supporting the bottom roller shafts at an end thereof opposite the bottom rollers, said support components being detachably mounted at a machine frame accommodating the drive shafts, whereby said bottom rollers and support components can be readily detached for servicing operations without disturbing the drive shafts.

2. A drafting unit according to claim 1, wherein the bottom rollers are each fastened to a support component by means of their own holding device.

3. A drafting unit according to claim 1, wherein a gear drive containing a shiftable coupling is provided for connecting respective bottom roller shafts to a pertaining drive shaft.

4. A drafting unit according to claim 2, wherein a gear drive containing a shiftable coupling is provided for connecting respective bottom roller shafts to a pertaining drive shaft.

5. A drafting unit according to claim 1 wherein the bottom rollers of a drafting unit are each held at a support component extending transversely with respect to the longitudinal direction of the machine and is mounted at the machine frame.

6. A drafting unit according to claim 4, wherein the bottom rollers of a drafting unit are each held at a support extending transversely with respect to the longitudinal direction of the machine and is mounted at the machine frame.

7. A drafting unit according to claim 5, wherein the support components are mounted at supporting elements extending transversely with respect to the longitudinal direction of the machine.

8. A drafting unit according to claim 6, wherein the support components are mounted at supporting elements extending transversely with respect to the longitudinal direction of the machine.

9. A drafting unit according to claim 5, wherein the support components are each mounted at a profile extending in the the longitudinal direction of the machine.

10. A drafting unit according to claim 7, wherein the support components are each mounted at a profile extending in the the longitudinal direction of the machine.

11. A drafting unit according to claim 7, wherein the support components are constructed as a frame.

12. A drafting unit according to claim 9, wherein the support components are constructed as a frame.

13. A drafting unit according to claim 5, wherein the support components accommodating the bottom rollers of two adjacent drafting units are constructed as a frame by means of struts extending through in the longitudinal direction of the machine.

14. A drafting unit according to claim 13, wherein one of the struts is constructed as a supporting rod on which a carrying and loading arm is pivotably disposed which accommodates the top rollers.

15. A drafting unit according to claim 6, wherein the support components accommodating the bottom rollers of two adjacent drafting units are constructed as a frame by means of struts extending through in the longitudinal direction of the machine.

16. A drafting unit according to claim 15, wherein one of the struts is constructed as a supporting rod on which a carrying and loading arm is pivotably disposed which accommodates the top rollers.

* * * * *